US011491611B2

(12) United States Patent
Nelson et al.

(10) Patent No.: US 11,491,611 B2
(45) Date of Patent: Nov. 8, 2022

(54) SPLASH GUARDS FOR GRINDER/POLISHER MACHINES AND GRINDER/POLISHER MACHINES HAVING SPLASH GUARDS

(71) Applicant: Illinois Tool Works Inc., Glenview, IL (US)

(72) Inventors: Calvin Nelson, Grayslake, IL (US); Stanislaw Cisowski, Vernon Hills, IL (US)

(73) Assignee: Illinois Tool Works Inc., Glenview, IL (US)

( * ) Notice: Subject to any disclaimer, the term of this patent is extended or adjusted under 35 U.S.C. 154(b) by 592 days.

(21) Appl. No.: 16/538,305

(22) Filed: Aug. 12, 2019

(65) Prior Publication Data

US 2020/0055163 A1 Feb. 20, 2020

Related U.S. Application Data

(60) Provisional application No. 62/718,776, filed on Aug. 14, 2018.

(51) Int. Cl.

| | |
|---|---|
| ***B24B 55/04*** | (2006.01) |
| ***B24B 41/02*** | (2006.01) |
| ***B24B 11/02*** | (2006.01) |

(52) U.S. Cl.

CPC ..... *B24B 55/04* (2013.01); *B24B 11/02* (2013.01)

(58) Field of Classification Search

CPC ..... B24B 55/04; B24B 55/045; B24B 55/12; B24B 55/228; B24B 7/08

See application file for complete search history.

(56) References Cited

U.S. PATENT DOCUMENTS 3,549,439 A * 12/1970 David ..... C04B 41/5353 216/101
3,611,654 A * 10/1971 Weber et al. ..... B24B 37/015 451/288
3,857,123 A * 12/1974 Walsh ..... B24B 37/107 451/288
4,244,775 A * 1/1981 D'Asaro ..... B24B 37/26 438/692
4,869,779 A * 9/1989 Acheson ..... B24B 37/30 438/692

(Continued)

OTHER PUBLICATIONS

Int'l Search Report and Written Opinion Appln No. PCT/US2019/046341 dated Oct. 14, 2019.

*Primary Examiner* — Joel D Crandall

(74) *Attorney, Agent, or Firm* — McAndrews, Held & Malloy, Ltd.

(57) ABSTRACT

Apparatus and systems are disclosed of a splash guard for a grinder/polisher having a base, a bowl, and a platen having an outer edge to prevent splashing during the grinding/polishing operation. The splash guard includes an inner sidewall, a lower rib, and outer sidewall, and an upper rib. The lower rib has an inner edge that is spaced at least 2.5 centimeters from the outer edge of the platen to prevent pinching of an operator's hands between the platen and the splash guard. The splash guard may also include a recess formed by the upper rib, outer sidewall, and lower rib, and at least a portion of an inner edge of the upper rib is extending further inwardly towards that platen than the inner edge of the lower rib.

20 Claims, 6 Drawing Sheets

(56) References Cited

U.S. PATENT DOCUMENTS

| | | | | | |
|---|---|---|---|---|---|
| 5,113,622 | A * | 5/1992 | Nishiguchi | B24B 37/04 | 451/7 |
| 5,280,663 | A * | 1/1994 | Proulx | A47L 13/48 | 451/353 |
| 5,593,537 | A * | 1/1997 | Cote | B24B 37/04 | 438/692 |
| 5,679,212 | A * | 10/1997 | Kato | B24B 7/228 | 438/692 |
| 5,735,992 | A * | 4/1998 | Miragaya | B24B 37/042 | 216/88 |
| 6,106,375 | A * | 8/2000 | Furusawa | B24B 37/04 | 451/442 |
| 6,159,082 | A * | 12/2000 | Sugiyama | B24B 57/02 | 451/60 |
| 9,017,146 | B2 * | 4/2015 | Nakamura | B24B 37/16 | 451/41 |
| 2003/0119435 | A1 | 6/2003 | Ohlendorf | | |
| 2003/0136684 | A1 * | 7/2003 | Duboust | B24B 49/10 | 205/640 |
| 2007/0141951 | A1 * | 6/2007 | Naoki | H01L 21/67051 | 451/5 |
| 2009/0318059 | A1 | 12/2009 | Shewey | | |
| 2010/0136884 | A1 * | 6/2010 | Oh | B24B 49/16 | 451/280 |
| 2010/0178857 | A1 | 7/2010 | Esenwein | | |
| 2012/0196517 | A1 * | 8/2012 | Huang | B24B 7/08 | 451/294 |

* cited by examiner

SPLASH GUARDS FOR GRINDER/POLISHER MACHINES AND GRINDER/POLISHER MACHINES HAVING SPLASH GUARDS

BACKGROUND

The present disclosure relates to splash guards for a grinder/polisher. More particularly, the present disclosure relates to improved splash guards for minimizing fluid splashing during the operation of the grinder/polisher.

SUMMARY

Splash guards for grinder/polisher machines and grinder/polisher machines having splash guards are disclosed, substantially as illustrated by and described in connection with at least one of the figures, as set forth more completely in the claims.

BRIEF DESCRIPTION OF THE DRAWINGS

The figures are not necessarily to scale. Where appropriate, similar or identical reference numbers are used to refer to similar or identical components.

DETAILED DESCRIPTION

Figure 1:
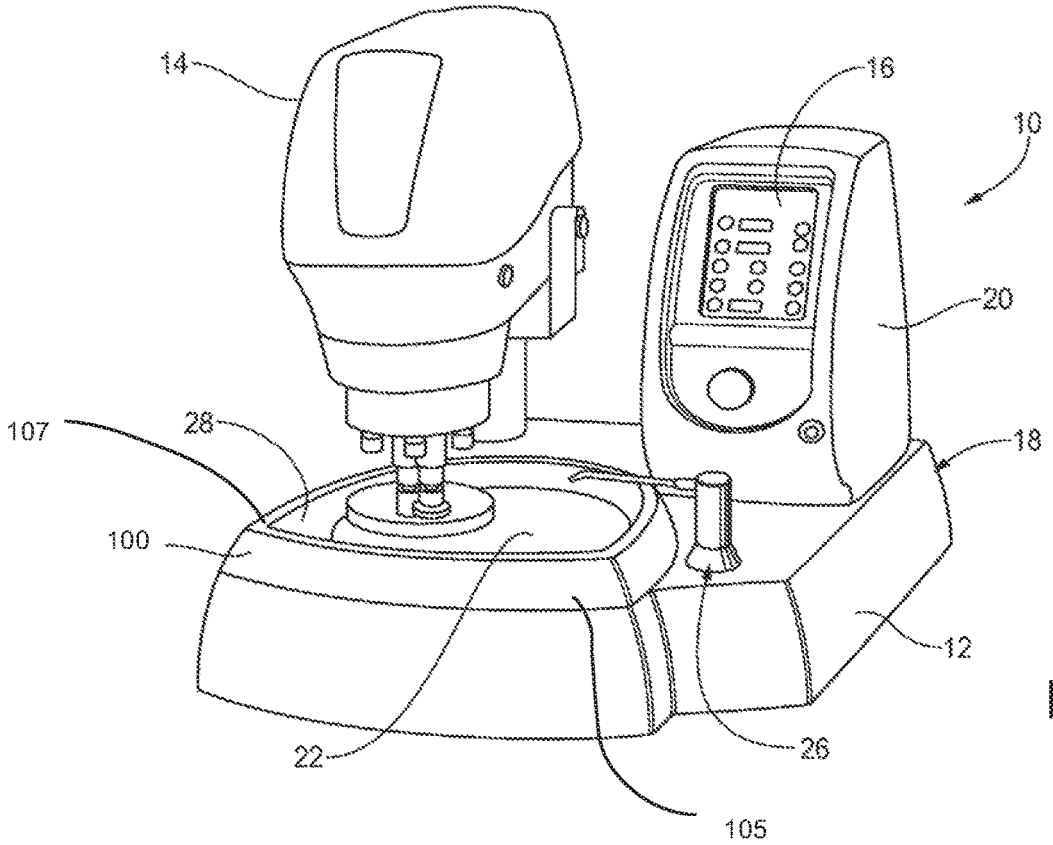
FIG. 1 is a perspective view of an example grinder/polisher including a splash guard, in accordance with aspects of this disclosure.
Figure 2:
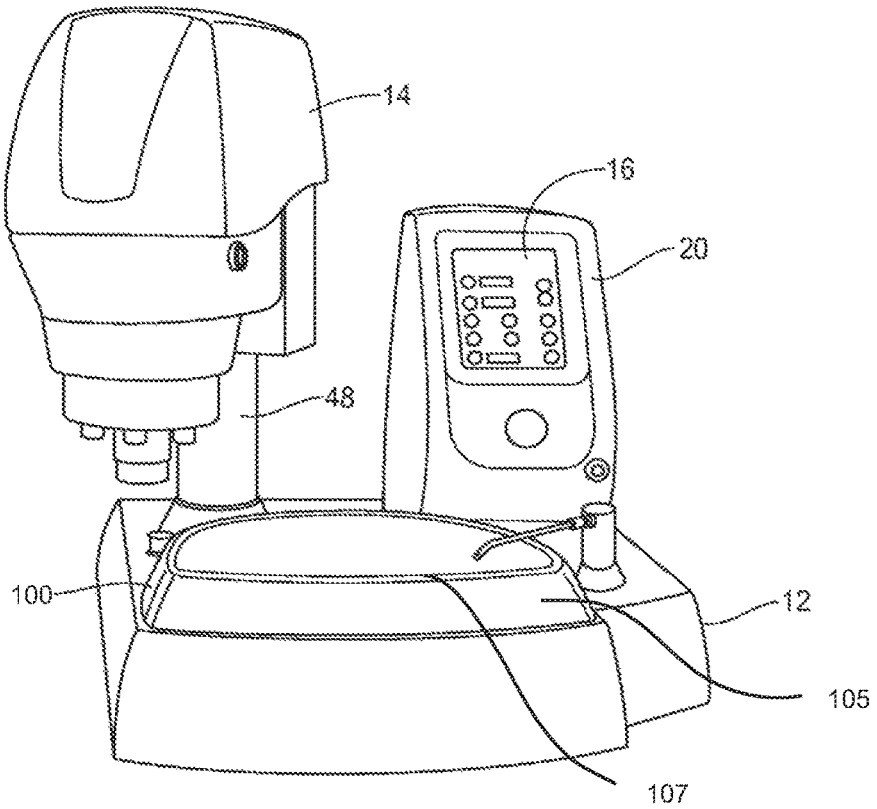
FIG. 2 is a front view of the example grinder/polisher of FIG. 1, shown with the head rotated slightly away from the base.
Figure 3:
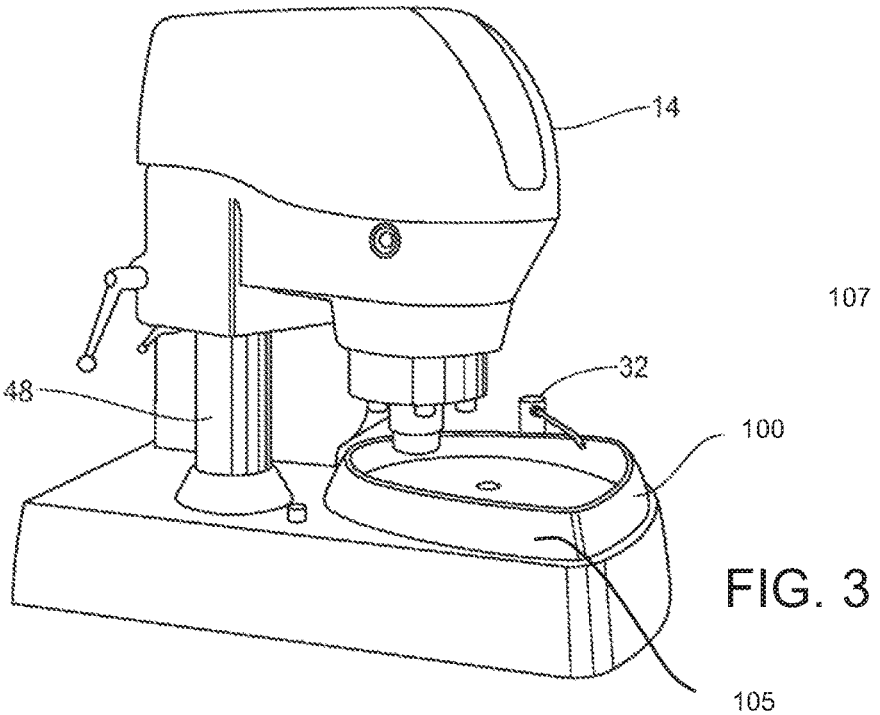
FIG. 3 is a side view of the example grinder/polisher of FIG. 1.
Figure 4:
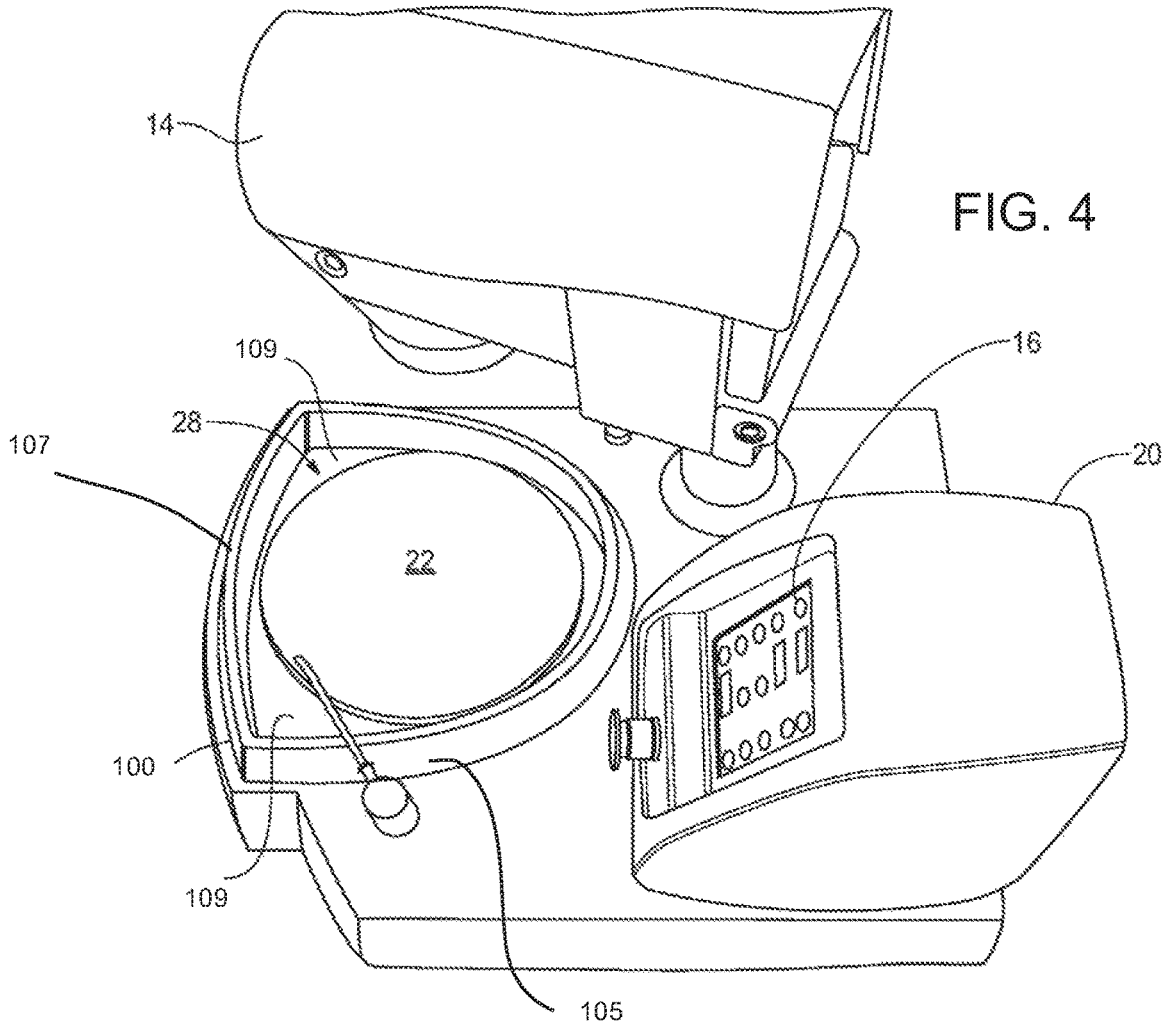
FIG. 4 is a top view of the example grinder/polisher of FIG. 1, showing the platen and the D-shaped base and splash guard, the grinder/polisher also shown with the head rotated slightly away from the base.

Disclosed are examples of an improved splash guard for a grinder/polisher machine having a base, a bowl, and a platen having an outer edge. Disclosed example splash guards reduce splashing from the grinding/polishing operation and/or eliminates potential pinch points in which an operator's hand may become pinched between the platen of a grinder/polisher and the splash guard.

The disclosed example splash guard includes an inner sidewall having a first end and a second end, and configured to engage with the base of the grinder/polisher such that the first end extends from the base and surrounds the bowl. The disclosed example splash guard also includes a lower rib having an inner edge and an outer edge, and extending from the second end of the inner side wall. The disclosed example splash guard further includes an outer sidewall having a first end and a second end, and extending from the outer edge of the lower rib such that the first end of the outer sidewall is proximate the outer edge of the lower rib. The disclosed example splash guard also includes an upper rib having an inner edge and an outer edge, and extending inwardly from the second end of the outer sidewall such that the outer edge of the upper rib is proximate the second end of the outer sidewall. In the disclosed example, the inner edge of the lower rib is spaced at least 2.5 centimeters from the outer edge of the platen.

The disclosed example splash guard may further include a recess formed by the upper rib, outer sidewall, and lower rib. At least a portion of the inner edge of the upper rib extends further inwardly towards the platen than the inner edge of the lower rib. In some examples, the inner edge of the lower rib forms a circular shape that is substantially concentric with the platen. In other examples, the inner sidewall, the outer sidewall, or the upper rib forms a D-Shape. In further examples, the lower rib is configured to rest on an upper lip of the bowl. In some examples, the outer sidewall is between 1.2 centimeters and 6.4 centimeters tall. In other examples, the inner edge of the lower rib is spaced between 2.5 centimeters and 5.1 centimeters from the outer edge of the platen. In further examples, the outer sidewall has a circumference larger than a circumference of the bowl. In some examples, the outer sidewall is inwardly angled towards the platen. In further examples, the splash guard is made from an elastic material.

The disclosed example grinder/polisher system includes a base having a bowl; a platen having an outer edge and positioned proximate the bowl; and a splash guard that extends from the base and surrounds the bowl. The disclosed example splash guard of the grinder/polisher system includes an inner sidewall having a first end and a second end, and configured to engage with the base such that the first end extends from the base and surrounds the bowl. The disclosed example splash guard of the grinder/polisher system also includes a lower rib having an inner edge and an outer edge, and extending from the second end of the inner side wall. The disclosed example splash guard of the grinder/polisher system further includes an outer sidewall having a first end and a second end, and extending from the outer edge of the lower rib such that the first end of the outer sidewall is proximate the outer edge of the lower rib. The disclosed example splash guard of the grinder/polisher system also includes an upper rib having an inner edge and an outer edge, and extending inwardly from the second end of the outer sidewall such that the outer edge of the upper rib is proximate the second end of the outer sidewall. In the disclosed example grinder/polisher system, the inner edge of the lower rib is spaced at least 2.5 centimeters from the outer edge of the platen.

The disclosed splash guard of the grinder/polisher system may further include a recess formed by the upper rib, outer sidewall, and lower rib. At least a portion of the inner edge of the upper rib extends further inwardly towards that platen than the inner edge of the lower rib. In some examples of the splash guard of the grinder/polisher system, the inner edge of the lower rib forms a circular shape that is substantially concentric with the platen. In other examples of the splash guard of the grinder/polisher system, the inner sidewall, the outer sidewall, or the upper rib forms a D-Shape. In further examples of the splash guard of the grinder/polisher system, the lower rib is configured to rest on an upper lip of the bowl. In some examples of the splash guard of the grinder/polisher system, the outer sidewall is between 1.2 centimeters and 6.4 centimeters tall. In other examples of the splash guard of the grinder/polisher system, the inner edge of the lower rib is spaced between 2.5 centimeters and 5.1 centimeters from the outer edge of the platen. In further examples of the splash guard of the grinder/polisher system, the outer sidewall has a circumference larger than a circumference of the bowl. In some examples of the splash guard of the grinder/polisher system, the splash guard is made from an elastic material. In some examples, the splash guard of the grinder/polisher system is removable from the base of the grinder polisher machine.

FIGS. 1-4 show examples of an improved splash guard 100 attached to a grinder/polisher 10. The grinder/polisher 10 includes, generally, a base 12, a head 14, and a control panel 16. In an example, the grinder/polisher 10 has a casing 18 that is fabricated from a cast material such as cast aluminum. The cast body (e.g., the head 14, the base 12, and the control panel housing 20) provides a stable support structure for the grinder/polisher 10, even under aggressive grinding conditions. The head 14 is mounted to the base 12 by a telescoping support 48. In some examples, the head 14 contains two drive systems (not shown)—one drive system for rotation of a specimen holder, and a height drive system for up and down movement of the head 14. The up and down directions, as used herein, refer to moving away and/or toward the base 14. The rotational and height movements are provided by the separate drive systems 50, 52.

The base 12 houses a platen 22, a platen drive (not shown), and a fluid supply and rinse components 26. The platen 22 holds a specimen or other material for manual and/or automatic grinding and/or polishing of the specimen. The platen 22 is removable and is mounted to a drive plate 40 that is driven, by a belt (not shown), from a platen drive motor (not shown) and forms part of the platen drive (not shown). The drive plate 40 and platen 22 are configured to rotate clockwise or counterclockwise (e.g., between 10 rpm and about 500 rpm). In some examples, the grinder/polisher 10 uses a high torque motor (not shown) to provide substantially constant speed and/or torque to the platen 22, regardless of the applied load.

The base 12 also houses a collection bowl or basin 28 in which the fluid is collected, as well as debris that is generated during grinding/polishing operation. As will be appreciated, there can be a considerable amount of debris that is generated during operation of the grinder/polisher 10, and as such, debris build-up on the bowl 28 can be problematic. In an example, the bowl 28 is removable from the base 12 to facilitate cleaning. In other examples, the bowl 28 includes a removable/replaceable/disposable bowl liner 30 (not shown) to facilitate cleaning, and that is intended to be disposed of, if necessary, so that a new, functional bowl liner is readily installed on the grinder/polisher 10. An example bowl liner 30 is preferably formed from a transparent plastic material to permit viewing the bowl as needed.

In the example of FIGS. 1-4, the grinder/polisher 10 includes a fluid supply and rinse 26 that includes a hose/dispenser assembly 32 mounted to the base 12. The assembly 32 is used to dispense or spray water into the bowl 28 to provide a water supply to help maintain the bowl 28 clear of debris. In an example, the grinder/polisher 10 includes a hose (not shown) constructed from a flexible rubber material stored in the base 12. The hose 34 can be stored in a system (not shown) that permits extending and retracting the hose 34 from the 12 for use. In another example, the hose 34 has a woven metal sheathing (not shown) to protect the hose 34 and to permit manipulating and positioning the hose 34 as desired.

Figure 5:
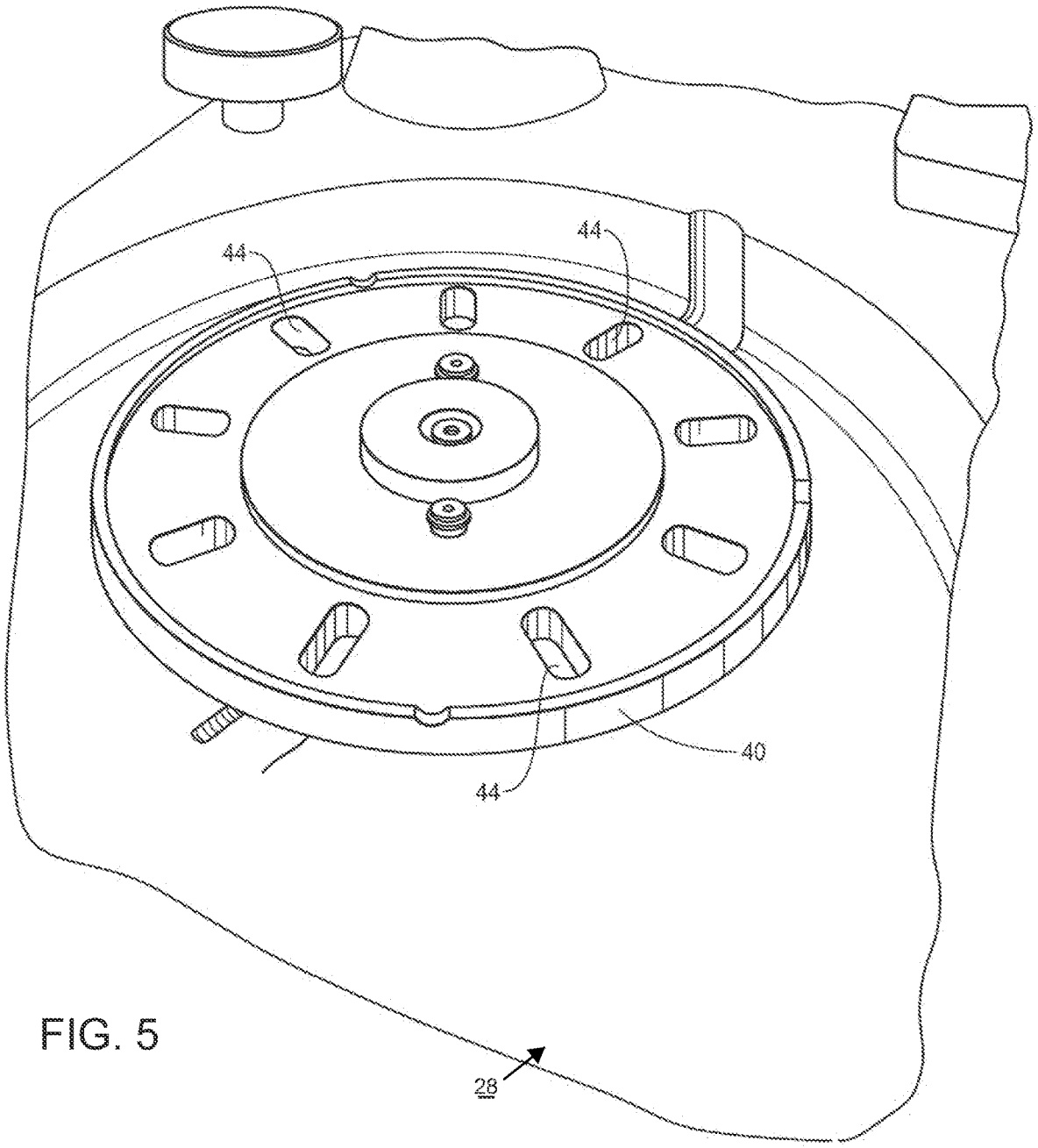
FIG. 5 is close-up view of the example drive plate of FIG. 1.
Figure 6:
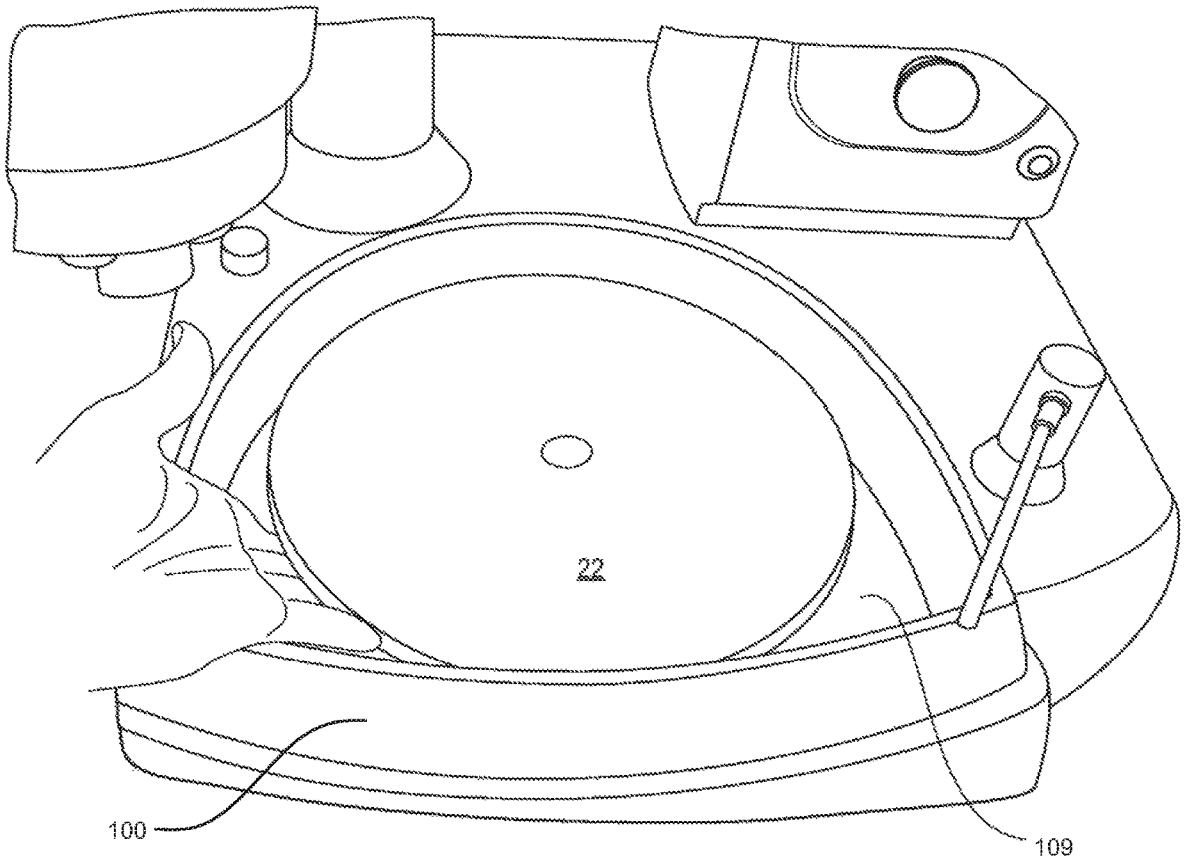
FIG. 6 is a close-up view of the example platen of FIG. 1, shown with an operator's hand to illustrate access to the platen.

In the example of FIG. 5, the drive plate 40 includes openings 44 in the bottom of the drive plate 44, so that water can enter up through the drive plate 40 onto the underside of the platen 22. In an example, the platen 22 has fins or spokes (not shown) on the underside that direct water outwardly to facilitate cooling the platen 22 from underneath. It has been observed that when a grind is particularly aggressive, the platen 22 may tend to heat, which, in turn may have an adverse effect on the specimen being prepared. Accordingly, platen 22 cooling helps to maintain the platen 22 at a more optimal operating temperature.

In the example of FIGS. 1-4, and 6-9, the grinder/polisher includes a splash guard 100 that is configured to removably engage with the base 12. In one example, the splash guard 100 engages with base 12 via a friction fit. In such an example, the splash guard 100 is pushed onto the base 12 to engage the splash guard 100 with the base 12, and is held in place due to the friction between the splash guard 100 and the base 12. In order to remove the splash guard 100 from the base 12, the splash guard 100 is pulled from the base 12 to disengage the friction fit. In another example, the splash guard 100 may engage with the base 12 via a snap fit.

In some examples, the splash guard 100 extends up from the base 12, surrounding the bowl 28. The splash guard 100 and the base 12 and bowl 28 at the portion that engages with the splash guard 100 have a D-shape which provides open corner areas 109 (see FIG. 6), so that an operator can access the area inside of the bowl 28, within the area bounded by the splash guard 100. The example splash guard 100 also includes a recess 120 formed by a lower rib 103, outer sidewall 105, and upper rib 107. The recess 120 traps and captures water being sprayed from the rotating platen 22 by deflecting water down and inwards towards the bowl 28.

Compared to conventional splash guards, the example splash guard 100 reduces (e.g., minimizes) the amount of splashing that occurs during the grinding/polishing operations while maintaining a high safety level. The example splash guard 100 ensures safe operation by, among other things, aligning the inner sidewall 101 closely with the bowl of the grinder/polisher 10, thereby increasing (e.g., widening) the space between the platen 22 and the splash ring 100 and forming a gap 110. As in shown in FIG. 6, the gap 110 helps to eliminate a potential safety hazard known as a "pinch point," in which objects can become pinched between the spinning platen 22 and another object such as the bowl 28 or conventional splash rings. The gap 110 and/or open corner areas 38 further enable an operator to reach into the bowl 28 and remove the platen 22.

In an example, the splash guard 100 is made from an elastic and/or impact-absorbing material, such as a soft rubber material, that reduces the energy of the moving water as the water hits any of the surfaces of the splash guard 100. Put differently, the soft rubber material helps absorb the energy from the splashing water to help reduce the water bouncing off the splash guard 100. By constructing the example splash guard 100 with impact-absorbing material(s), the splash guard 100 may further reduce splashing relative to a hard and rigid material, which does not reduce the energy of the moving water as much as the impact-absorbing material.

Figure 7:
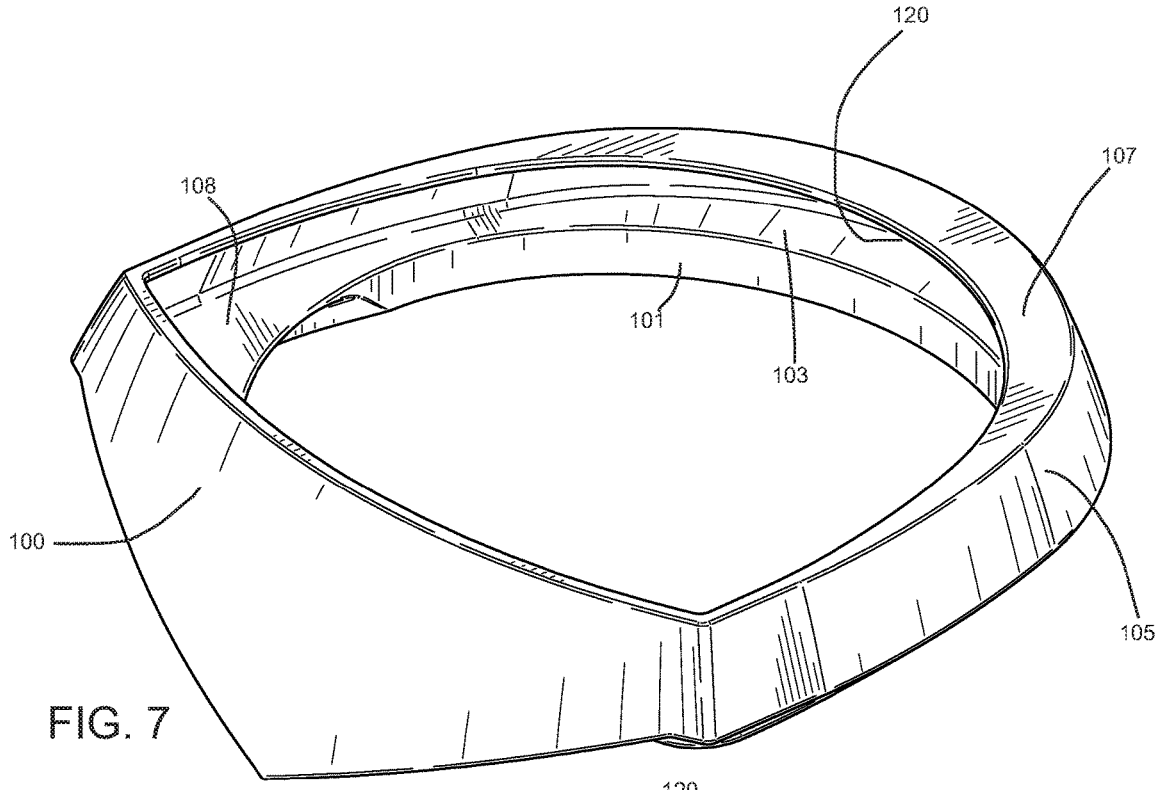
FIG. 7 is a perspective view of the example splash guard of FIG. 1.
Figure 8:
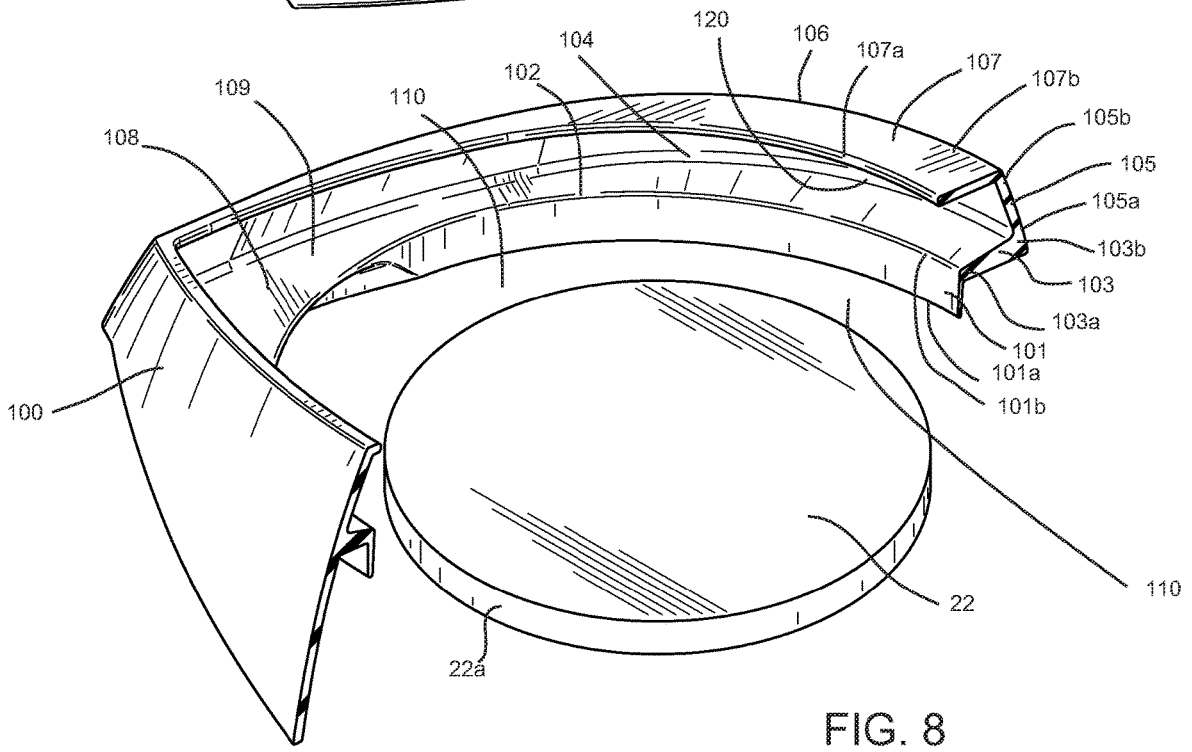
FIG. 8 is a cut-away perspective view of the example splash guard of FIG. 1.

FIGS. 7 and 8 show an example splash guard 100. The splash guard includes an inner sidewall 101, an outer sidewall 105, a lower rib 103, and an upper rib 107. As is shown in the examples of FIGS. 7 and 8, the inner sidewall 101, outer sidewall 105, lower rib 103, and upper rib 104 form a D-Shape. The inner sidewall 101 includes a first end 101*a* and a second end 101*b*. In an example, the inner sidewall 101 extends substantially vertically between the first end 101*a* and second end 101*b* from an engagement portion 60 of the base 12 such that the first end 101*a* is the lowest portion of the splash guard 100 to contact the base 12. In a further example, the inner sidewall 101 matches the shape and curvature of the bowl 28 such that the inner sidewall 101 completely surrounds the bowl 28. In an example, the bowl 28 is D-shaped, thus, the lower sidewall 101 is also D-shaped. In examples, in which the bowl 28 has other shapes, such as round, square, etc. the splash ring 100 will match the shape of the bowl 28. For example, if the bowl 28 is round, the splash ring 100 will be substantially round. If the bowl 28 is square shaped, the splash guard 100 will be substantially square shaped.

In the example of FIGS. 7 and 8, the lower rib 103 includes an inner edge 103*a* and an outer edge 103*b*. The lower rib 103 extends substantially horizontally between the inner edge 103*a* to the outer edge 103*b* from the second end 101*b* of the inner sidewall 101. The inner edge 103*b* is circular in shape and generally concentric with the platen 22. As discussed above, the inner edge of 103*b* is spaced at a uniform distance from the outer edge of the platen 22*a* forming gap 110 to minimize pinch points. In one example, the gap 110 is between 2.5 centimeters and 5.1 centimeters to reduce or minimize the potential for the presence of a pinch point between the platen 22 and the splash guard 100. In the example, a gap 110 between 2.5 centimeters and 5.1 centimeters enhances the operational safety of the grinder/polisher 10 and splash guard 100 by having a sufficient amount of space for an operator's fingers between the platen 22 and splashguard 100. Having a gap 110 greater than 5.1 centimeters may unnecessarily increase the overall size of the splash guard 100. In a preferred example, the gap 110 is 2.5 centimeters.

In the example in which the splash guard 100 is D-shaped the inner edge 103*a* of the lower rib 103 maintains its uniform circular shape and gap 110 by having protruding web portions 108 projecting inwards from the squared corners of the D-shaped lower sidewall 101 towards the platen 22. By contrast, at the round portions of the D-shaped lower sidewall 101, the second end 101*b* of lower sidewall 101 merges with the inner edge 103*a* of the lower rib 103 forming an edge 102. In the example in which the lower sidewall 101 is circular in shape, there may be web portion(s) 108 if the lower sidewall is spaced between 2.5 centimeters and 5.1 centimeters from the platen 22. In such an example, the gap 110 is maintained by the edge 102 along the circumference of the lower sidewall 101. If the lower sidewall 101 is spaced further than 5.1 centimeters from the platen 22, to ensure that the gap 110 remains between 2.5 centimeters and 5.1 centimeters, there may be a continuous web portion 108 extending inwardly towards the platen 22 from the second end 101*b* of the lower sidewall 101. In the example in which the splash guard 100 is square shaped, there are web portions 108 projecting from each corner of the square-shaped lower sidewall 101 to form the uniform gap 110 and circular inner edge 103*a* of lower rib 103.

As is shown in the example of FIGS. 7 and 8, the outer sidewall 105 includes a first end 105*a* and a second end 105*b*. The outer sidewall 105 extends between the first end 105*a* and the second end 105*b* from the outer edge 103*b* of the lower rib 103. In such an example the outer edge 103*b* of the lower rib 103 merges with the first end 105*a* of the outer sidewall 105 forming an edge 104. In an example, the outer sidewall 105 is angled inwardly towards the platen 22, in which the vertical height is between 1.2 centimeters and 6.4 centimeters. In such an example, the inward angle can be any angle between 45 degrees and 90 degrees. In another example, the outer sidewall 105 is substantially vertical and has a height between 1.2 centimeters and 6.4 centimeters. The angle, length, and circumference of the outer sidewall 105 may be influenced by the curvature and shape of the base 12 and/or bowl 28. As is shown in the example of FIGS. 7 and 8, the outer sidewall 105 has a larger circumference than the inner sidewall 101. As is further shown in FIGS. 1-3, 9 the outer sidewall 105 follows the curvature of the base 12.

In the example of FIGS. 7 and 8, the upper rib 107 includes an inner edge 107*a* and an outer edge 107*b*. The upper rib 107 extends substantially horizontally between the inner edge 107*a* and the outer edge 107*b* from the second end 105*b* of the outer sidewall 105. In such an example the second end 105*b* of the outer sidewall 105 merges with the outer edge 107*b* of the upper rib 107 forming an edge 106. In an example, the upper rib 107 has a D-shape. The shape of the upper rib 107 is influenced by the shape of the bowl 28, inner sidewall 101 and outer sidewall 105. In the example in which the splash guard 100 is circular, the upper rib 107 is also circular. Conversely, in the example in which the splash guard 100 is square-shaped, the upper rib 107 is also square-shaped. In a further example, at least a portion of the inner edge 107*a* of the upper rib 107 extends further towards the platen 22 than the inner edge 103*a* of the lower rib forming an overhang. The example in which the splash guard 100 is D-shaped, only the squared corners of the D-Shaped upper rib 107 do not extend beyond the inner edge 103*a* of the lower rib 103. In one example, at least a portion of the inner edge 107*a* of the upper rib 107 extends over the platen 22.

As discussed above, the lower rib 103, outer sidewall 105, and upper rib 107 form a recess 120 that traps water being sprayed by the rotating platen. The splash guard 100 utilizes the overhang created by the upper rib 107 to reduce the size of the opening in which spraying water can escape and thereby greatly reduces splashing. The recess 120 further reduces splashing by trapping water that bounces off the lower rib 103, outer sidewall 105, and/or upper rib. The trapped water is redirected down and inwards towards the bowl by the upper lip 107, outer sidewall 105, and lower lip 103.

Figure 9:
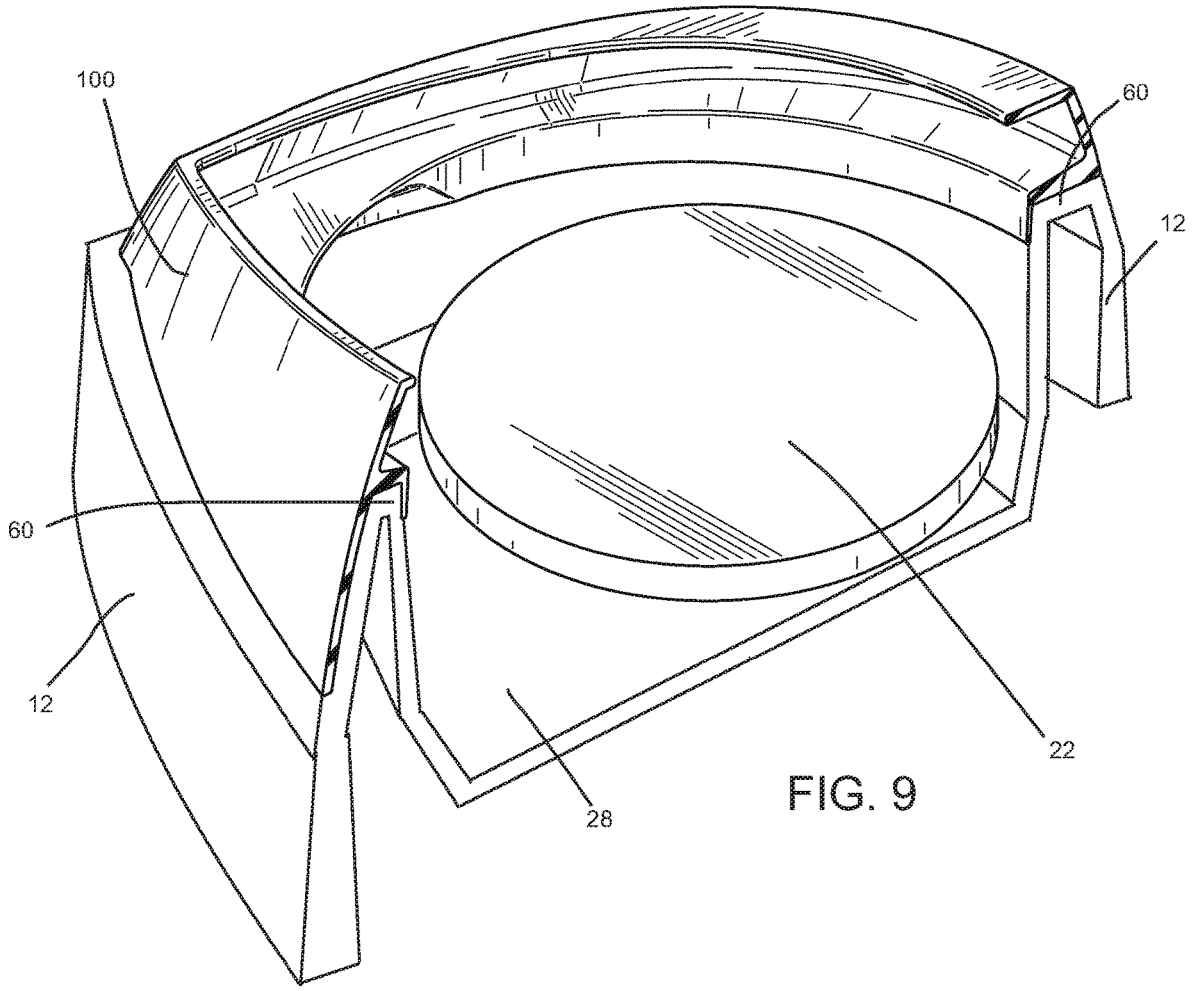
FIG. 9 is a cut-away perspective view of the example splash guard of FIG. 1 shown in an engaged position with the D-shaped base and bowl of the grinder/polisher.

FIG. 9 shows a cut-away view of an example splash guard 100 engaged with the base 12 and bowl 28 of a grinder/polisher 10. As discussed in the example above, the splash guard 100 engages with the base 12 and bowl 28 via a friction fit. As is shown in FIG. 9, the splash guard 100 engages with an engagement portion 60 of the base 12. In one example, the bowl 28 is integral with the base 12. In another example the bowl 28 is a separate component and is placed into the base 12. The platen 22 is positioned within the bowl 28.

While the present apparatus and/or system has been described with reference to certain implementations, it will be understood by those skilled in the art that various changes may be made and equivalents may be substituted without departing from the scope of the present method and/or system. For example, components of disclosed examples may be combined, divided, re-arranged, and/or otherwise modified. In addition, many modifications may be made to adapt a particular situation or material to the teachings of the present disclosure without departing from its scope. Therefore, the present apparatus and/or system are not limited to the particular implementations disclosed. Instead, the present apparatus and/or system will include all implementations falling within the scope of the appended claims, both literally and under the doctrine of equivalents.

What is claimed is:

1. A splash guard for a grinder polisher having a base, a bowl, and a platen having an outer edge, the splash guard comprising:

an inner sidewall having a first end and a second end, and configured to engage with the base such that the first end extends from the base and surrounds the bowl;

a lower rib having an inner edge and an outer edge, and extending from the second end of the inner side wall;

an outer sidewall having a first end and a second end, and extending from the outer edge of the lower rib such that the first end of the outer sidewall is proximate the outer edge of the lower rib; and an upper rib having an inner edge and an outer edge, and extending inwardly from the second end of the outer sidewall such that the outer edge of the upper rib is proximate the second end of the outer sidewall; and wherein the inner edge of the lower rib is spaced at least 2.5 centimeters from the outer edge of the platen.

2. The splash guard of claim 1, wherein the splash guard further comprises a recess formed by the upper rib, outer sidewall, and lower rib, and at least a portion of the inner edge of the upper rib is extending further inwardly towards the platen than the inner edge of the lower rib.

3. The splash guard of claim 1, wherein the inner edge of the lower rib forms a circular shape that is substantially concentric with the platen.

4. The splash guard of claim 1, wherein the inner sidewall, the outer sidewall, or the upper rib forms a D-Shape.

5. The splash guard of claim 1, wherein the lower rib is configured to rest on an upper lip of the bowl.

6. The splash guard of claim 1, wherein the outer sidewall is between 1.2 centimeters and 6.4 centimeters tall.

7. The splash guard of claim 1, wherein the inner edge of the lower rib is spaced between 2.5 centimeters and 5.1 centimeters from the outer edge of the platen.

8. The splash guard of claim 1, wherein the outer sidewall has a circumference larger than a circumference of the bowl.

9. The splash guard of claim 1, wherein the outer sidewall is inwardly angled towards the platen.

10. The splash guard of claim 1, wherein the splash guard is made from an elastic material.

11. The grinder polisher system of claim 10, wherein the splash guard is made from an elastic material.

12. The grinder polisher system of claim 10, wherein the splash guard is removable from the base of the grinder polisher machine.

13. A grinder polisher system comprising:

a grinder polisher, comprising:

a base having a bowl;

a platen having an outer edge and positioned proximate the bowl; and a splash guard that extends from the base and surrounds the bowl, the splash guard comprising:

an inner sidewall having a first end and a second end, and configured to engage with the base such that the first end extends from the base and surrounds the bowl;

a lower rib having an inner edge and an outer edge, and extending from the second end of the inner side wall;

an outer sidewall having a first end and a second end, and extending from the outer edge of the lower rib such that the first end of the outer sidewall is proximate the outer edge of the lower rib; and an upper rib having an inner edge and an outer edge, and extending inwardly from the second end of the outer sidewall such that the outer edge of the upper rib is proximate the second end of the outer sidewall; and wherein the inner edge of the lower rib is spaced at least 2.5 centimeters from the outer edge of the platen.

14. The grinder polisher system of claim 13, wherein the splash guard further comprises a recess formed by the upper rib, outer sidewall, and lower rib, and at least a portion of the inner edge of the upper rib is extending further inwardly towards that platen than the inner edge of the lower rib.

15. The grinder polisher system of claim 13, wherein the inner edge of the lower rib forms a circular shape that is substantially concentric with the platen.

16. The grinder polisher system of claim 13, wherein the inner sidewall, the outer sidewall, or the upper rib forms a D-Shape.

17. The grinder polisher system of claim 13, wherein the lower rib is configured to rest on an upper lip of the bowl.

18. The grinder polisher system of claim 13, wherein the outer sidewall is between 1.2 centimeters and 6.4 centimeters tall.

19. The grinder polisher system of claim 13, wherein the inner edge of the lower rib is spaced between 2.5 centimeters and 5.1 centimeters from the outer edge of the platen.

20. The grinder polisher system of claim 13, wherein the outer sidewall has a circumference larger than a circumference of the bowl.

* * * * *